US010301978B2

(12) United States Patent
Hofer et al.

(10) Patent No.: US 10,301,978 B2
(45) Date of Patent: May 28, 2019

(54) MULTI-PIECE VALVE TRAIN BLOCK WITH INTEGRATED CAMSHAFT SUPPORT

(71) Applicant: Schaeffler Technologies AG & Co. KG, Herzogenaurach (DE)

(72) Inventors: Béla Hofer, Troy, MI (US); Sagar Shinde, Farmington Hills, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 246 days.

(21) Appl. No.: 15/476,417

(22) Filed: Mar. 31, 2017

(65) Prior Publication Data

US 2018/0283230 A1 Oct. 4, 2018

(51) Int. Cl.

| | |
|---|---|
| ***F01L 1/34*** | (2006.01) |
| ***F01L 1/053*** | (2006.01) |
| ***F01L 9/02*** | (2006.01) |
| *F01L 1/047* | (2006.01) |

(52) U.S. Cl.

CPC ..... *F01L 1/053* (2013.01); *F01L 9/021* (2013.01); *F01L 2001/0476* (2013.01); *F01L 2810/02* (2013.01)

(58) Field of Classification Search

CPC ..... F01L 1/3442; F01L 1/053; F01L 2810/02; F01L 2001/0476; F01L 2001/34426

See application file for complete search history.

(56) References Cited

U.S. PATENT DOCUMENTS 4,593,657 A 6/1986 Aoi et al.
2008/0264366 A1* 10/2008 Hashimoto ..... F01L 1/053 123/90.17

FOREIGN PATENT DOCUMENTS

EP 2 397 674 B1 10/2012

OTHER PUBLICATIONS

Technology INA UniAir System, Schaeffler Automotive Aftermarket, Product Literature, pp. 6-7. 2011.

* cited by examiner

*Primary Examiner* — Zelalem Eshete
(74) *Attorney, Agent, or Firm* — Volpe and Koenig, P.C.

(57) ABSTRACT

A variable valve train module for an engine includes a camshaft including at least one cam and a valve control block. The valve control block is positioned on a cylinder head of the engine. The valve control block includes a first sidewall and a second sidewall and houses valve train components configured to control the timing of at least one valve in the cylinder heads between the first and second sidewalls. The valve control block includes a support block forming the first sidewall and a plurality of integral bearing supports extending inwardly from the first sidewall and supporting the camshaft. The valve control block also includes a reinforcing block forming the second sidewall and which is attached to the support block.

20 Claims, 4 Drawing Sheets

MULTI-PIECE VALVE TRAIN BLOCK WITH INTEGRATED CAMSHAFT SUPPORT

FIELD OF INVENTION

The present invention relates to a valve train block, and, more particularly, to a multi-piece valve train block having integrated camshaft support.

BACKGROUND

Some engines include a variable valve train module which controls valve lift through hydraulic operation. This module can include a valve control block positioned on one or more cylinder heads of an engine. The valve control block can include various spaces for components and cavities for hydraulic fluid which together control valve timing and lift. For example, the valve control block may include a pump which pressurizes a cavity connected to a valve actuator, providing valve lift event control in a manner which benefits engine efficiency (e.g., through variable valve actuation depending on the situation).

Implementation of a hydraulic variable valve train system can sometimes eliminate a traditional intake camshaft. In its place, an exhaust camshaft which is external to the valve control block may be positioned for interaction with the variable valve train system components. However, in some instances it is beneficial to include the intake camshaft within the hydraulic variable valve train module. This could cut down on the additional space that is added by the system and allow it to be more easily used in conjunction with certain types of engines, including overhead camshaft engines.

An example of an overhead camshaft engine is described in U.S. Pat. No. 4,593,657 ("the '657 patent"). The '657 patent includes a camshaft which is integrated with and supported by the cylinder heads of the engine. In particular, integrated support bearings are built into the structure of the cylinder heads for supporting the camshaft. This type of engine could benefit from a hydraulic valve train system, but it may be difficult to do so without removing the camshaft. Moreover, the type of bearing support used in the '657 patent could be improved as they do not allow for ease of access to nearby components (e.g., within the cylinder head).

The present disclosure is directed to overcoming one or more problems of the prior art, including the application of a variable valve timing block which works in conjunction with the intake camshaft and solidly supporting the camshaft while providing access to the nearby components.

SUMMARY

In one aspect, the present disclosure is directed to variable valve train module for an engine. The variable valve train module includes a camshaft and a block. The camshaft includes at least one cam. The block is configured to be positioned on a cylinder head of the engine. The block includes a first sidewall and a second sidewall and houses valve train components configured to control the timing of at least one valve in the cylinder heads between the first and second sidewalls. The block includes a support block forming the first sidewall and a plurality of integral bearing supports extending inwardly from the first sidewall and supporting the camshaft. The block also includes a reinforcing block forming the second sidewall and which is attached to the support block In another aspect, the support block includes a lower portion which has a base configured to be attached to the cylinder heads of the engine. The support block also includes an upper portion including the first sidewall on a first lateral side, a shelf on a second lateral side, and the bearing supports positioned therebetween. The reinforcing block is supported by the shelf and is attached to the support block by a plurality of fasteners.

BRIEF DESCRIPTION OF THE DRAWING(S)

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENT(S)

The present disclosure relates to a variable valve train module for an engine. The variable valve train module includes a valve control block which defines cavities and spaces for receiving valve train components, including pumps, actuators, and a camshaft. The valve control block supports the camshaft internally, thereby saving packaging space compared to external camshaft configurations. The valve control block supports the camshaft in a manner which allows the associated cams to interact with and provide input to the internal components. The valve control block is formed in multiple pieces so that the internal components and cavities are accessible for ease of installation, repair, and/or maintenance.

Figure 1:
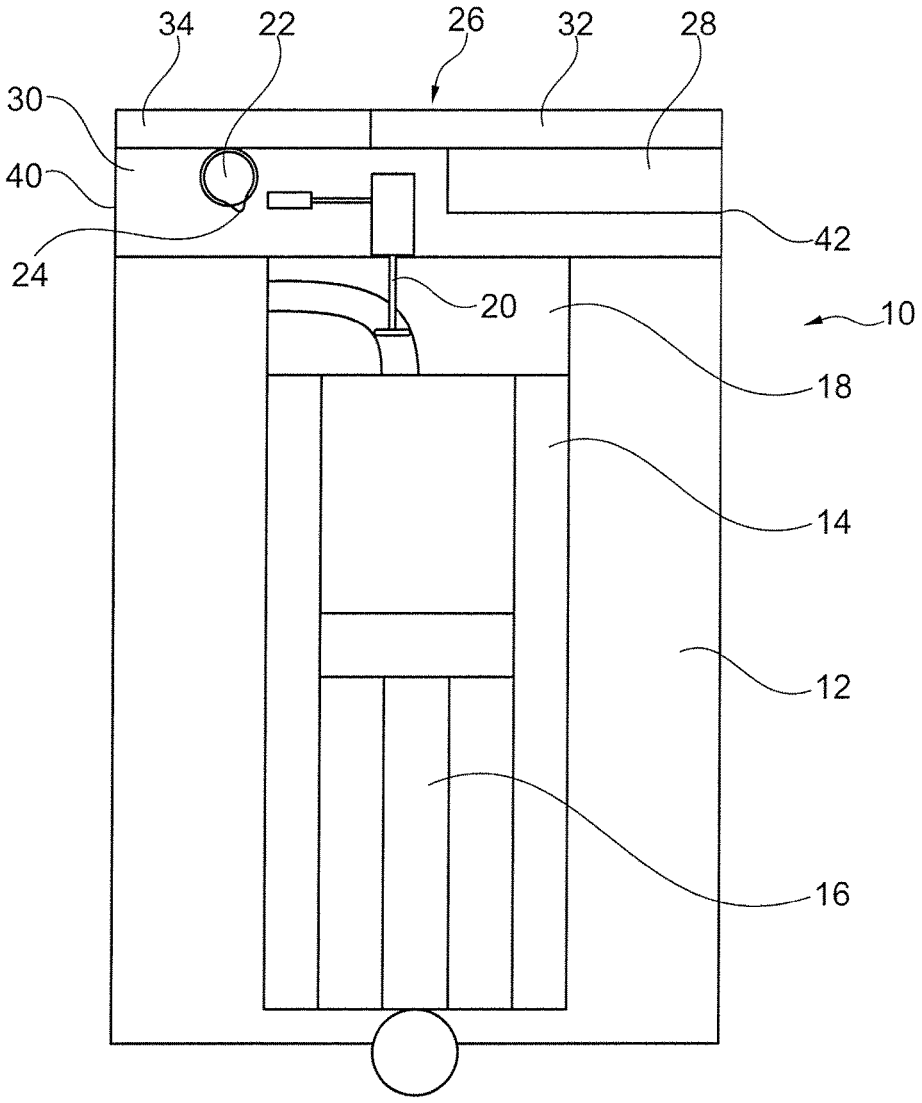
FIG. 1 is a schematic illustration of an engine, including a variable valve train module.

FIG. 1 schematically illustrates an exemplary embodiment of an engine 10. The engine 10 is preferably an internal combustion engine, but other types of engines are possible. In one embodiment, the engine 10 includes an engine block 12 defining a plurality of cylinders 14. The cylinders 14 receive corresponding reciprocating pistons 16. The pistons 16 move within the cylinders 14 as the engine 10 cycles through various intake, power, compression, and exhaust stages.

The engine 10 further includes cylinder heads 18 which are positioned on top of the engine block 12. The cylinder heads 18 include cavities for receiving at least a portion of a valve 20. The valves 20 include intake and exhaust valves which are selectively opened and closed to facilitate the various combustion stages of the engine 10. The valves 20 may be operated at least in part due to a camshaft 22. The camshaft 22 rotates to provide a cyclical input to the valves 20 through one or more cams 24.

The engine 10 also includes a variable valve train module 26. The variable valve train module 26 is positioned on the cylinder head 18 and includes components which control the valves 20. The variable valve train module 26 includes a valve control block 28 which supports the camshaft 22. The variable valve train module 26 includes features which allow for the cyclical input of the cams 24 of the camshaft 22 to be converted into a variably-controllable input to the valves 20. In this way, a lift profile of the valves 20 may be adjusted and controlled through the variable valve train module 26 to promote efficient operation of the engine 10. In an exemplary embodiment, the valve control block 28 is a multi-part structure including at least a support block 30, a reinforcing block 32, and a cover 34.

Figure 2:
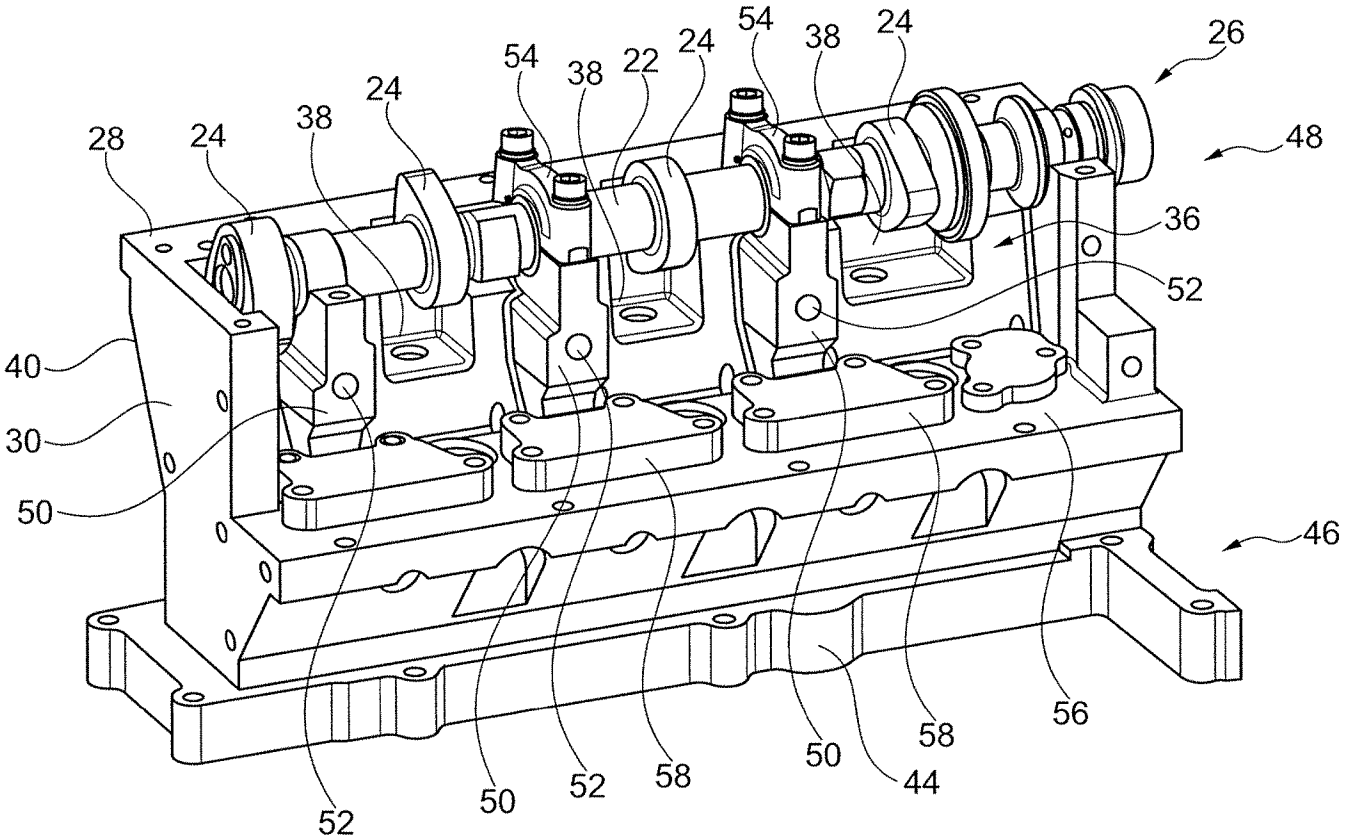
FIG. 2 is a perspective view illustration of a variable valve train module with a side support and cover removed.

FIG. 2 illustrates the variable valve train module 26 in more detail, with the reinforcing block 32 and the cover 34 removed. The valve control block 28 forms a housing for variable valve train components, including one or more pumps, oil galleries, accumulators, and hydraulic actuators. For example, the valve control block 28 includes one or more cavities for receiving these components. These cavities may be machined or otherwise formed into a solid brick during a manufacturing process. In addition, the valve control block 28 defines a central area 36 which includes one or more cutouts 38 which receive a respective cam 24. The cutouts 38 allow the cams 24 of the camshaft 22 to rotate within the valve control block 28. The support block 30 forms a first sidewall 40 on one lateral side of this central area 36. The reinforcing block 32, as will be described in more detail, forms a second sidewall 42 on an opposite lateral side of the central area 36 (shown in FIG. 4).

In an exemplary embodiment, the support block 30 further includes a base 44. The base 44 is attached to and supported on the cylinder head 18. The support block 30 also includes a lower portion 46. The lower portion 46 extends from the base 44 and includes cavities for receiving variable valve train components (shown only in FIG. 4). An upper portion 48 is above the lower portion 46. The base 44, lower portion 46, and upper portion 48 may be integrally formed as a single piece.

The upper portion 48 preferably includes, on a first lateral side, the first sidewall 40 or at least a portion thereof. On an inward side of the first sidewall 40 (e.g., a side which faces the central area 36), the cutouts 38 are formed. In addition, a plurality of bearing supports 50 extend from the inward side of the first sidewall 40. The bearing supports 50 are alternately formed between the cutouts 38. The bearing supports 50 include a portion which is integrated into the first sidewall 40 and an opposite-side portion which is exposed when the reinforcing block 32 is removed. Each opposite-side portion includes an aperture 52.

As shown in FIG. 2, the camshaft 22 is positioned on and propped up by the bearing supports 50. The bearing supports 50 interface with the reinforcing block 32 and include portions which extend underneath the camshaft 22 to form a rigid structure. Each bearing support 50 includes a bearing cap 54 associated therewith. The bearing cap 54 is secured to the associated bearing support 50 and extends over a top portion of the camshaft 22. The bearing support 50 and bearing cap 54 together encircle a portion of the camshaft 22, thereby holding the camshaft 22 in position while also facilitating rotation of the camshaft 22.

An opposite side of the upper portion 48 (e.g., a second lateral side) includes a shelf 56. The shelf 56 provides a support surface for the reinforcing block 32. In addition, the shelf 56 forms a mounting surface for one or more valve train components. For example, a removable mounting member 58 may be attached to the shelf 56, thereby enclosing a valve train component in a cavity formed in the support block 30, while retaining accessibility.

As shown in FIG. 2, many of the internal features of the variable valve train module 26 are exposed with the reinforcing block 32 removed. This provides access to the internal components, as well as the camshaft 22, for ease of installation (e.g., machining of cavities and placement of components) and maintenance (e.g., cleaning or repair).

Figure 3:
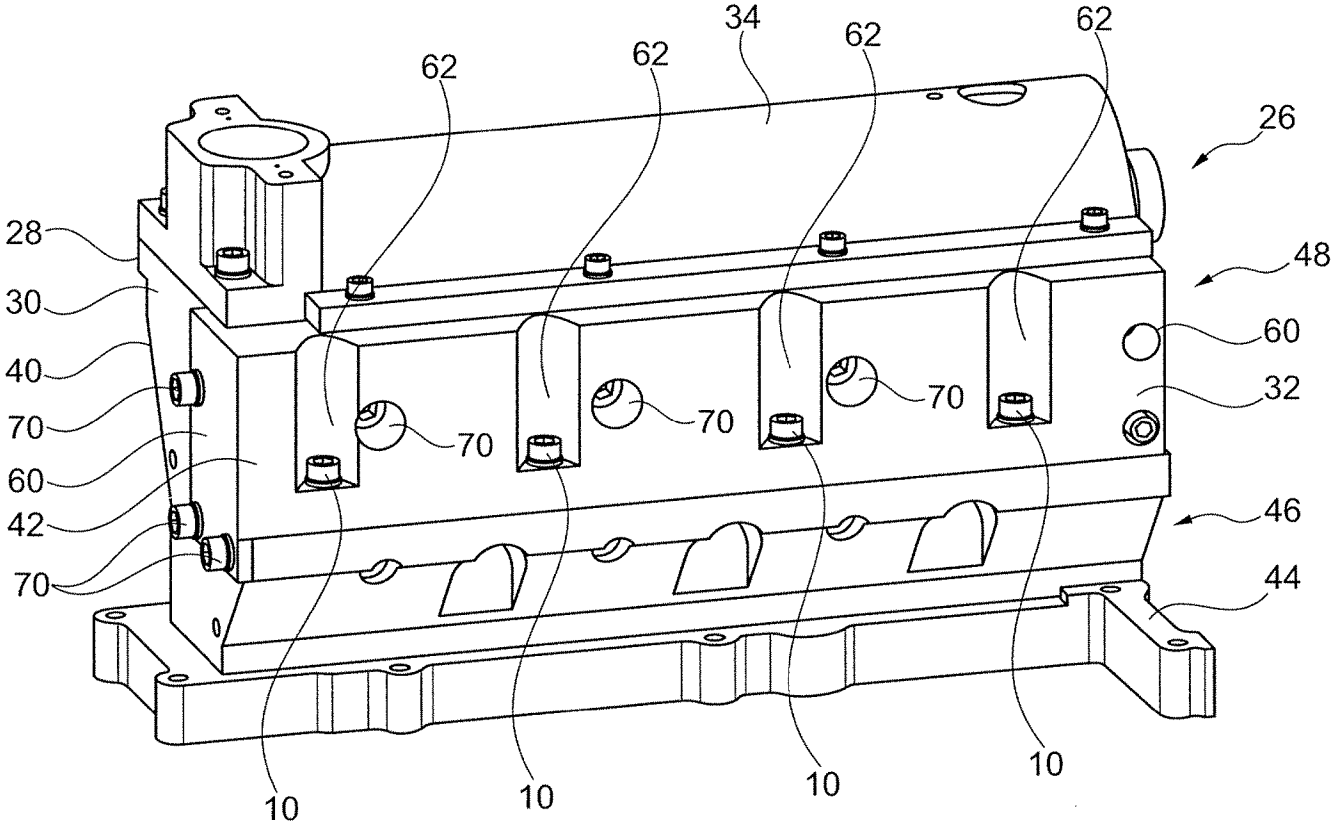
FIG. 3 is a perspective view illustration of the variable valve train module with the side support and cover in place.

FIG. 3 further illustrates the variable valve train module 26 with the reinforcing block 32 and the cover 34 in place. The reinforcing block 32 covers the opposite lateral side of the central area 36 and includes the second sidewall 42. The cover 34 is attached to upper portions of the support block 30 and the reinforcing block 34 and covers the camshaft 22.

The reinforcing block 32 is removably attached to the support block 30 by a plurality of fasteners 70. The support block 30 preferably includes a plurality of apertures 52 configured to receive the fasteners 70. For example, the support block 30 includes the apertures 52 which are aligned with apertures in the reinforcing block for receiving a respective fastener 70 therethrough. The support block 30 may include additional apertures (e.g., as shown in FIG. 2).

The reinforcing block 32 preferably includes features which allow corresponding apertures to be aligned for the insertion of the fasteners 70. For example, the reinforcing block 32 may include side flanges 60 which overlap longitudinal sidewalls of the support block 30. In this way, fasteners 70 connect the blocks 30, 32 at opposing longitudinal ends. In addition, the reinforcing block 32 may include cutouts 62 which allow for vertically-oriented fasteners 70 to be inserted through the reinforcing block 32 and into the shelf 56. Additional or alternative connection means are also possible.

FIG. 3 further illustrates the cover 34. The cover 34 is a protection and sealing component which spans the tops of the support block 30 and reinforcing block 32. The cover 34 at least partially encloses the camshaft 22 in the central area 36 of the valve control block 28. In other words, the cover 34 is placed on top of the camshaft 22 in a manner that does not interfere with the rotation of the camshaft 22. The camshaft support area (e.g., the bearing supports 50 and bearing caps 54) and the camshaft 22 are well-lubricated components. The cover 34 helps to retain the lubricating oil within the camshaft support area and helps to protect the area from contamination and interference by foreign objects and materials.

Figure 4:
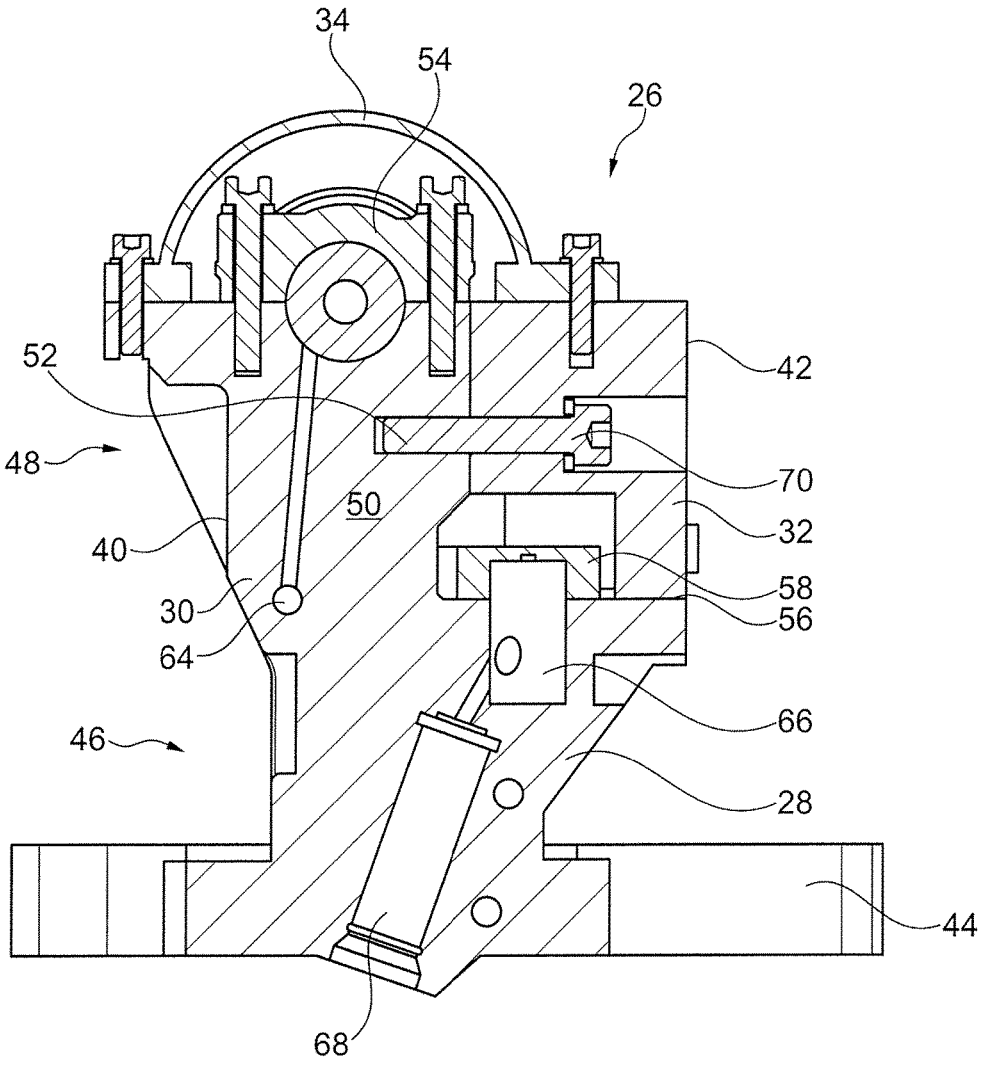
FIG. 4 is a cross-sectional view of the variable valve train module.

FIG. 4 illustrates a cross-sectional view of the variable valve train module 26. The support block 30 forms the base structure and is attached at its bottom to the cylinder heads 18. Moreover, the support block 30 includes cavities, cutouts, and/or channels for receiving various components of the variable valve train module 26. For example, the support block 30 may include a lubrication channel 64 which supplies lubricating oil to the camshaft 22. The support block 30 may also include a cavity 66 which forms or receives an oil gallery. The oil gallery may be the main supply of hydraulic fluid for the variable valve train module 26. The cavity 66 may be formed at least in part by the removable mounting member 58 such that it is accessible when the reinforcing block 32 is removed. The support block 30 may further include a cavity 68 for receiving a hydraulic brake, lash adjuster, valve actuator, or the like, and which may be connected to the oil gallery. The support block 30 may include additional cavities for other components, such as pumps which pressurize the fluid in the oil gallery (e.g. via interaction with the camshaft 22), accumulators which maintain pressure in the oil gallery, valve actuators, or other components which form the variable valve train module 26.

The support block 30 further forms the first sidewall 40 of the valve control block 28 and includes the integral bearing supports 50. The bearing supports 50 provide a lower bearing surface for a portion of the camshaft 22. The bearing caps 54 are attached to the bearing supports 50 to provide an upper bearing surface for the camshaft 22. The reinforcing block 32 is attached to the support block 30 and forms the second sidewall 42 of the valve control block 28. As shown in FIG. 4, the reinforcing block 32 is attached to the support block 30 through fasteners 70, including at least one fastener 70 which is inserted into the bearing support 50 via aperture 52. The cover 34 is attached to upper portions of the support block 30 and reinforcing block 32, spanning and covering the camshaft 22. In an exemplary embodiment, the cover 34 is thin-walled, curved component. This configuration allows the cover 34 to protect the camshaft support area without interfering with the camshaft 22 or its cams 24 or taking up a large amount of space.

In operation, the engine 10 cycles through various combustion stages which move the pistons 16 to produce mechanical output. As is known in the art, the opening and closing timing of the valves 20 in part contributes to the efficient operation of the engine to produce the mechanical output. Some engines cyclically operate the valves 20 through direct input from the camshaft. The disclosed variable valve train module 26 provides hydraulic components which control the valve timing and lift indirectly by using the camshaft 22 as an input to drive a pump which pressurizes an oil gallery. The oil pressure is used to provide precise control of the lift profile of the valves 20. It should be understood however, that at least some of the disclosed features may apply to other variable valve train modules, including those that do not use hydraulic valve control.

The disclosed multi-part valve control block 28 provides a structure which houses and positions the components of the hydraulic valve train system while providing additional advantages compared to previous designs. For example, the configuration of the support block 30 and reinforcing block 32 as separate (and possibly detachable) components provides access to the central area 36. This access allows for ease of installation, repair, and maintenance for the variable valve train module 26. For example, the support block 30 configuration provides an open design for machining, drilling, and other operations which provide needed flexibility during the manufacturing process.

In addition, this configuration allows the camshaft 22 to be integrated into the valve control block 28 and used to provide input to the hydraulic system. This cuts down on packaging space and allows the use of separate camshafts for intake and exhaust control. For example, where a single camshaft may provide input for intake and exhaust valve systems in previous configurations, this design provides for the use of the separate intake camshaft, which is integrated in and protected by the valve control block 28.

The disclosed camshaft support configuration is made possible in part by the bearing supports 52 being integrated into the support block 30 and extending only from the first sidewall 40. This provides sufficient support for the camshaft 22 to be positioned during an installation or maintenance process, while also providing direct attachment points (e.g., via apertures 52) for the reinforcing block 32 to provide additional support to the structure. The additional support provided by the reinforcing block 32 helps to secure the structure in place and inhibits movement or noise during operation of the engine 10.

Having thus described the presently preferred embodiments in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiments and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A variable valve train module for an engine, comprising:

a camshaft including at least one cam; and a valve control block configured to be positioned on a cylinder head of the engine, the valve control block including a first sidewall and a second sidewall and housing valve train components configured to control the timing of at least one valve in the cylinder head between the first and second sidewalls, wherein the valve control block comprises:

a support block forming the first sidewall and including a plurality of integral bearing supports extending inwardly from the first sidewall and supporting the camshaft, and a reinforcing block forming the second sidewall and attached to the support block.

2. The variable valve train module of claim 1, wherein the reinforcing block is attached to the support block by a plurality of fasteners.

3. The variable valve train module of claim 2, wherein the bearing supports each include an aperture configured to receive a respective one of the plurality of fasteners.

4. The variable valve train module of claim 1, further comprising a plurality of bearing caps each secured to a respective one of the plurality of bearing supports.

5. The variable valve train module of claim 4, wherein the plurality of bearing supports each form a lower bearing surface for a portion of the camshaft, and the plurality of bearing caps each form an upper bearing surface for a portion of the camshaft.

6. The variable valve train module of claim 1, wherein the support block includes a plurality of cutouts respectively positioned between pairs of the bearing supports, the plurality of cutouts configured to receive a cam of the camshaft.

7. The variable valve train module of claim 1, wherein the support block includes at least one cavity for receiving a valve train component.

8. The variable valve train module of claim 7, wherein the at least one cavity includes an oil supply passage.

9. The variable valve train module of claim 7, wherein the at least one cavity includes a cavity which receives a hydraulic component.

10. The variable valve train module of claim 9, wherein the hydraulic component is one of a pump, a brake, or an actuator.

11. The variable valve train module of claim 1, wherein the reinforcing block includes a pair of flanges configured to overlap the support block at opposing longitudinal ends thereof.

12. The variable valve train module of claim 1, wherein the valve control block further comprises a cover which is attached to upper portions of the support block and the reinforcing block and covers the camshaft.

13. The variable valve train module of claim 12, wherein the cover includes a curved shape.

14. A variable valve train module for an engine, comprising:

a camshaft including at least one cam; and a valve control block configured to be positioned on a cylinder head of the engine, the valve control block including a first sidewall and a second sidewall and housing valve train components configured to control the timing of at least one valve in the cylinder heads between the first and second sidewalls, wherein the valve control block comprises:

a support block forming the first sidewall and including a plurality of integral bearing supports extending inwardly from the first sidewall and supporting the camshaft, and a reinforcing block forming the second sidewall and attached to the support block, wherein the support block includes:

a lower portion having a base configured to be attached to the cylinder heads of the engine, an upper portion including the first sidewall on a first lateral side, a shelf on a second lateral side, and the bearing supports positioned therebetween, and wherein the reinforcing block is supported by the shelf and attached to the support block by a plurality of fasteners.

15. The variable valve train module of claim 14, further including a removable mounting member attached to the shelf, the removable mounting member including a valve train component.

16. The variable valve train module of claim 15, wherein the valve train component is an oil gallery.

17. The variable valve train module of claim 14, wherein the reinforcing block includes cutouts in the second sidewall which receive a respective fastener of the plurality of fasteners and which are inserted through the reinforcing block and into the shelf.

18. The variable valve train module of claim 14, wherein the support block includes a plurality of cutouts respectively positioned between pairs of the bearing supports, the plurality of cutouts configured to receive a cam of the camshaft.

19. The variable valve train module of claim 14, wherein the valve control block further comprises a cover which is attached to upper portions of the support block and the reinforcing block and covers the camshaft.

20. The variable valve train module of claim 14, wherein the bearing supports each include an aperture configured to receive a respective one of the plurality of fasteners.

* * * * *